US009512699B2

(12) United States Patent
Wenger, Jr. et al.

(10) Patent No.: US 9,512,699 B2
(45) Date of Patent: Dec. 6, 2016

(54) SYSTEMS AND METHODS FOR REGULATING AN IN SITU PYROLYSIS PROCESS

(71) Applicants: Lloyd M. Wenger, Jr., Houston, TX (US); William P. Meurer, Magnolia, TX (US); Ana L Braun, Houston, TX (US); Ana Maria Dos Santos Carmo, Houston, TX (US); Michael W. Lin, Bellaire, TX (US); Zhibin Wei, Sugar Land, TX (US)

(72) Inventors: Lloyd M. Wenger, Jr., Houston, TX (US); William P. Meurer, Magnolia, TX (US); Ana L Braun, Houston, TX (US); Ana Maria Dos Santos Carmo, Houston, TX (US); Michael W. Lin, Bellaire, TX (US); Zhibin Wei, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 149 days.

(21) Appl. No.: 14/447,484

(22) Filed: Jul. 30, 2014

(65) Prior Publication Data

US 2015/0107828 A1 Apr. 23, 2015

Related U.S. Application Data

(60) Provisional application No. 61/894,295, filed on Oct. 22, 2013.

(51) Int. Cl.
*E21B 43/24* (2006.01)
*E21B 47/00* (2012.01)
(Continued)

(52) U.S. Cl.
CPC ..... *E21B 43/00* (2013.01); *E21B 43/24* (2013.01); *E21B 47/00* (2013.01)

(58) Field of Classification Search
CPC .. G01N 2030/8405; E21B 43/24; E21B 43/30; E21B 43/243; E21B 43/34; E21B 47/00
See application file for complete search history.

(56) References Cited

U.S. PATENT DOCUMENTS 363,419 A 5/1887 Poetsch
895,612 A 8/1908 Baker
(Continued)

FOREIGN PATENT DOCUMENTS

CA 994694 8/1976
CA 1288043 8/1991
(Continued)

OTHER PUBLICATIONS

ASTM D 4294 10 "Standard Test Method for Sulfur in Petroleum and Petroleum Products by Energy-Dispersive X-Ray Florescence Spectrometry" (Retrieved Dec. 19, 2014).
(Continued)

*Primary Examiner* — Zakiya W Bates
(74) *Attorney, Agent, or Firm* — ExxonMobil Upstream Research Company Law Dept.

(57) ABSTRACT

Systems and methods for regulating an in situ pyrolysis process. The methods may include producing a product fluid stream from an active pyrolysis region of a subterranean formation. The methods further may include detecting a concentration of a first component in the product fluid stream and/or detecting a concentration of a second component in the product fluid stream. The concentration of the first component may be indicative of an intensive property of the pyrolyzed fluid production system. The concentration of the second component may be indicative of an extensive
(Continued)

property of the pyrolyzed fluid production system. The methods further may include regulating at least one characteristic of the pyrolyzed fluid production system based upon the concentration of the first component and/or based upon the concentration of the second component. The systems may include systems that are configured to perform the methods.

26 Claims, 3 Drawing Sheets

(51) Int. Cl.
*G01N 33/00* (2006.01)
*E21B 43/00* (2006.01)

(56) References Cited

U.S. PATENT DOCUMENTS 1,342,780 A 6/1920 Vedder
1,422,204 A 7/1922 Hoover et al.
1,666,488 A 4/1928 Crawshaw
1,701,884 A 2/1929 Hogle
1,872,906 A 8/1932 Doherty
2,033,560 A 3/1936 Wells
2,033,561 A 3/1936 Wells
2,534,737 A 12/1950 Rose
2,584,605 A 2/1952 Merriam et al.
2,634,961 A 4/1953 Ljungstrom
2,732,195 A 1/1956 Ljungstrom
2,777,679 A 1/1957 Ljungstrom
2,780,450 A 2/1957 Ljungstrom
2,795,279 A 6/1957 Sarapuu
2,812,160 A 11/1957 West et al.
2,813,583 A 11/1957 Marx et al.
2,847,071 A 8/1958 De Priester
2,887,160 A 5/1959 De Priester.
2,895,555 A 7/1959 De Priester
2,923,535 A 2/1960 Ljungstrom
2,944,803 A 7/1960 Hanson
2,952,450 A 9/1960 Purre
2,974,937 A 3/1961 Kiel
3,004,601 A 10/1961 Bodine
3,013,609 A 12/1961 Brink
3,095,031 A 6/1963 Eurenius et al.
3,106,244 A 10/1963 Parker
3,109,482 A 11/1963 O'Brien
3,127,936 A 4/1964 Eurenius
3,137,347 A 6/1964 Parker
3,149,672 A 9/1964 Orkiszewski et al.
3,170,815 A 2/1965 White
3,180,411 A 4/1965 Parker
3,183,675 A 5/1965 Schroeder
3,183,971 A 5/1965 McEver et al.
3,194,315 A 7/1965 Rogers
3,205,942 A 9/1965 Sandberg
3,225,829 A 12/1965 Chown et al.
3,228,869 A 1/1966 Irish
3,241,611 A 3/1966 Dougan
3,241,615 A 3/1966 Brandt et al.
3,254,721 A 6/1966 Smith et al.
3,256,935 A 6/1966 Nabor et al.
3,263,211 A 7/1966 Heidman
3,267,680 A 8/1966 Schlumberger
3,271,962 A 9/1966 Dahms et al.
3,284,281 A 11/1966 Thomas
3,285,335 A 11/1966 Reistle, Jr.
3,288,648 A 11/1966 Jones
3,294,167 A 12/1966 Vogel
3,295,328 A 1/1967 Bishop
3,323,840 A 6/1967 Mason et al.
3,358,756 A 12/1967 Vogel
3,372,550 A 3/1968 Schroeder
3,376,403 A 4/1968 Mircea
3,382,922 A 5/1968 Needham
3,400,762 A 9/1968 Peacock et al.
3,436,919 A 4/1969 Shock et al.
3,439,744 A 4/1969 Bradley
3,455,392 A 7/1969 Prats
3,461,957 A 8/1969 West
3,468,376 A 9/1969 Slusser et al.
3,494,640 A 2/1970 Coberly et al.
3,500,913 A 3/1970 Nordgren et al.
3,501,201 A 3/1970 Closmann et al.
3,502,372 A 3/1970 Prats
3,513,914 A 5/1970 Vogel
3,515,213 A 6/1970 Prats
3,516,495 A 6/1970 Patton
3,521,709 A 7/1970 Needham
3,528,252 A 9/1970 Gail
3,528,501 A 9/1970 Parker
3,547,193 A 12/1970 Gill
3,559,737 A 2/1971 Ralstin
3,572,838 A 3/1971 Templeton
3,592,263 A 7/1971 Nelson
3,599,714 A 8/1971 Messman
3,602,310 A 8/1971 Halbert
3,613,785 A 10/1971 Closmann et al.
3,620,300 A 11/1971 Crowson
3,642,066 A 2/1972 Gill
3,661,423 A 5/1972 Garret
3,692,111 A 9/1972 Breithaupt et al.
3,695,354 A 10/1972 Dilgren et al.
3,700,280 A 10/1972 Papadopoulos et al.
3,724,225 A 4/1973 Mancini et al.
3,724,543 A 4/1973 Bell et al.
3,729,965 A 5/1973 Gartner
3,730,270 A 5/1973 Allred
3,739,851 A 6/1973 Beard
3,741,306 A 6/1973 Papadopoulos
3,759,328 A 9/1973 Ueber et al.
3,759,329 A 9/1973 Ross
3,759,574 A 9/1973 Beard
3,779,601 A 12/1973 Beard
3,880,238 A 4/1975 Tham et al.
3,882,937 A 5/1975 Robinson
3,882,941 A 5/1975 Pelofsky
3,888,307 A 6/1975 Closmann
3,924,680 A 12/1975 Terry
3,943,722 A 3/1976 Ross
3,948,319 A 4/1976 Pritchett
3,950,029 A 4/1976 Timmins
3,958,636 A 5/1976 Perkins
3,967,853 A 7/1976 Closmann et al.
3,978,920 A 9/1976 Bandyopadhyay
3,999,607 A 12/1976 Pennington et al.
4,003,432 A 1/1977 Paull et al.
4,005,750 A 2/1977 Shuck
4,007,786 A 2/1977 Schlinger
4,008,762 A 2/1977 Fisher et al.
4,008,769 A 2/1977 Chang
4,014,575 A 3/1977 French et al.
4,030,549 A 6/1977 Bouck
4,037,655 A 7/1977 Carpenter
4,043,393 A 8/1977 Fisher et al.
4,047,760 A 9/1977 Ridley
4,057,510 A 11/1977 Crouch et al.
4,065,183 A 12/1977 Hill et al.
4,067,390 A 1/1978 Camacho et al.
4,069,868 A 1/1978 Terry
4,071,278 A 1/1978 Carpenter et al.
4,093,025 A 6/1978 Terry
4,096,034 A 6/1978 Anthony
4,125,159 A 11/1978 Vann
4,140,180 A 2/1979 Bridges et al.
4,148,359 A 4/1979 Laumbach et al.
4,149,595 A 4/1979 Cha
4,160,479 A 7/1979 Richardson et al.
4,163,475 A 8/1979 Cha et al.
4,167,291 A 9/1979 Ridley
4,169,506 A 10/1979 Berry
4,185,693 A 1/1980 Crumb et al.
4,186,801 A 2/1980 Madgavkar et al.
4,193,451 A 3/1980 Dauphine

(56) References Cited

U.S. PATENT DOCUMENTS

| | | | |
|---|---|---|---|
| 4,202,168 | A | 5/1980 | Acheson et al. |
| 4,239,283 | A | 12/1980 | Ridley |
| 4,241,952 | A | 12/1980 | Ginsburgh |
| 4,246,966 | A | 1/1981 | Stoddard et al. |
| 4,250,230 | A | 2/1981 | Terry |
| 4,265,310 | A | 5/1981 | Britton et al. |
| 4,271,905 | A | 6/1981 | Redford et al. |
| 4,272,127 | A | 6/1981 | Hutchins |
| 4,285,401 | A | 8/1981 | Erickson |
| RE30,738 | E | 9/1981 | Bridges et al. |
| 4,318,723 | A | 3/1982 | Holmes et al. |
| 4,319,635 | A | 3/1982 | Jones |
| 4,320,801 | A | 3/1982 | Rowland et al. |
| 4,324,291 | A | 4/1982 | Wong et al. |
| 4,340,934 | A | 7/1982 | Segesman |
| 4,344,485 | A | 8/1982 | Butler |
| 4,344,840 | A | 8/1982 | Kunesh |
| 4,353,418 | A | 10/1982 | Hoekstra et al. |
| 4,358,222 | A | 11/1982 | Landau |
| 4,362,213 | A | 12/1982 | Tabor |
| 4,368,921 | A | 1/1983 | Hutchins |
| 4,369,842 | A | 1/1983 | Cha |
| 4,372,615 | A | 2/1983 | Ricketts |
| 4,375,302 | A | 3/1983 | Kalmar |
| 4,384,614 | A | 5/1983 | Justheim |
| 4,396,211 | A | 8/1983 | McStravick et al. |
| 4,397,502 | A | 8/1983 | Hines |
| 4,401,162 | A | 8/1983 | Osborne |
| 4,412,585 | A | 11/1983 | Bouck |
| 4,417,449 | A | 11/1983 | Hegarty et al. |
| 4,449,585 | A | 5/1984 | Bridges et al. |
| 4,468,376 | A | 8/1984 | Suggitt |
| 4,470,459 | A | 9/1984 | Copland |
| 4,472,935 | A | 9/1984 | Acheson et al. |
| 4,473,114 | A | 9/1984 | Bell et al. |
| 4,474,238 | A | 10/1984 | Gentry et al. |
| 4,476,926 | A | 10/1984 | Bridges et al. |
| 4,483,398 | A | 11/1984 | Peters et al. |
| 4,485,869 | A | 12/1984 | Sresty et al. |
| 4,487,257 | A | 12/1984 | Dauphine |
| 4,487,260 | A | 12/1984 | Pittman et al. |
| 4,495,056 | A | 1/1985 | Venardos |
| 4,511,382 | A | 4/1985 | Valencia et al. |
| 4,532,991 | A | 8/1985 | Hoekstra et al. |
| 4,533,372 | A | 8/1985 | Valencia et al. |
| 4,537,067 | A | 8/1985 | Sharp et al. |
| 4,545,435 | A | 10/1985 | Bridges et al. |
| 4,546,829 | A | 10/1985 | Martin et al. |
| 4,550,779 | A | 11/1985 | Zakiewicz |
| 4,552,214 | A | 11/1985 | Forgac et al. |
| 4,567,945 | A | 2/1986 | Segalman |
| 4,585,063 | A | 4/1986 | Venardos et al. |
| 4,589,491 | A | 5/1986 | Perkins |
| 4,589,973 | A | 5/1986 | Minden |
| 4,602,144 | A | 7/1986 | Vogel |
| 4,607,488 | A | 8/1986 | Karinthi et al. |
| 4,626,665 | A | 12/1986 | Fort |
| 4,633,948 | A | 1/1987 | Closmann |
| 4,634,315 | A | 1/1987 | Owen et al. |
| 4,637,464 | A | 1/1987 | Forgac et al. |
| 4,640,352 | A | 2/1987 | Vanmeurs et al. |
| 4,671,863 | A | 6/1987 | Tejeda |
| 4,694,907 | A | 9/1987 | Stahl et al. |
| 4,704,514 | A | 11/1987 | Van Egmond et al. |
| 4,705,108 | A | 11/1987 | Little et al. |
| 4,706,751 | A | 11/1987 | Gondouin |
| 4,730,671 | A | 3/1988 | Perkins |
| 4,737,267 | A | 4/1988 | Pao et al. |
| 4,747,642 | A | 5/1988 | Gash et al. |
| 4,754,808 | A | 7/1988 | Harmon et al. |
| 4,776,638 | A | 10/1988 | Hahn |
| 4,779,680 | A | 10/1988 | Sydansk |
| 4,815,790 | A | 3/1989 | Rosar et al. |
| 4,817,711 | A | 4/1989 | Jeambey |
| 4,828,031 | A | 5/1989 | Davis |
| 4,860,544 | A | 8/1989 | Krieg et al. |
| 4,886,118 | A | 12/1989 | Van Meurs et al. |
| 4,923,493 | A | 5/1990 | Valencia et al. |
| 4,926,941 | A | 5/1990 | Glandt et al. |
| 4,928,765 | A | 5/1990 | Nielson |
| 4,929,341 | A | 5/1990 | Thirumalachar et al. |
| 4,954,140 | A | 9/1990 | Kawashima et al. |
| 4,974,425 | A | 12/1990 | Krieg et al. |
| 5,016,709 | A | 5/1991 | Combe et al. |
| 5,036,918 | A | 8/1991 | Jennings et al. |
| 5,050,386 | A | 9/1991 | Krieg et al. |
| 5,051,811 | A | 9/1991 | Williams et al. |
| 5,055,030 | A | 10/1991 | Schirmer |
| 5,055,180 | A | 10/1991 | Klaila |
| 5,082,055 | A | 1/1992 | Hemsath |
| 5,085,276 | A | 2/1992 | Rivas et al. |
| 5,117,908 | A | 6/1992 | Hofmann |
| 5,120,338 | A | 6/1992 | Potts, Jr. et al. |
| 5,217,076 | A | 6/1993 | Masek |
| 5,236,039 | A | 8/1993 | Edelstein |
| 5,255,742 | A | 10/1993 | Mikus |
| 5,275,063 | A | 1/1994 | Steiger et al. |
| 5,277,062 | A | 1/1994 | Blauch et al. |
| 5,297,420 | A | 3/1994 | Gilliland |
| 5,297,626 | A | 3/1994 | Vinegar et al. |
| 5,305,829 | A | 4/1994 | Kumar |
| 5,325,918 | A | 7/1994 | Berryman et al. |
| 5,346,307 | A | 9/1994 | Ramirez et al. |
| 5,372,708 | A | 12/1994 | Gewertz |
| 5,377,756 | A | 1/1995 | Northrop et al. |
| 5,392,854 | A | 2/1995 | Vinegar et al. |
| 5,411,089 | A | 5/1995 | Vinegar et al. |
| 5,416,257 | A | 5/1995 | Peters |
| 5,539,853 | A | 7/1996 | Jamaluddin et al. |
| 5,620,049 | A | 4/1997 | Gipson et al. |
| 5,621,844 | A | 4/1997 | Bridges |
| 5,621,845 | A | 4/1997 | Bridges et al. |
| 5,635,712 | A | 6/1997 | Scott et al. |
| 5,661,977 | A | 9/1997 | Shnell |
| 5,724,805 | A | 3/1998 | Golomb et al. |
| 5,730,550 | A | 3/1998 | Andersland et al. |
| 5,753,010 | A | 5/1998 | Sircar |
| 5,838,634 | A | 11/1998 | Jones et al. |
| 5,844,799 | A | 12/1998 | Joseph et al. |
| 5,868,202 | A | 2/1999 | Hsu |
| 5,899,269 | A | 5/1999 | Wellington et al. |
| 5,905,657 | A | 5/1999 | Celniker |
| 5,907,662 | A | 5/1999 | Buettner et al. |
| 5,938,800 | A | 8/1999 | Verrill et al. |
| 5,956,971 | A | 9/1999 | Cole et al. |
| 6,015,015 | A | 1/2000 | Luft et al. |
| 6,016,867 | A | 1/2000 | Gregoli et al. |
| 6,023,554 | A | 2/2000 | Vinegar et al. |
| 6,055,803 | A | 5/2000 | Mastronarde et al. |
| 6,056,057 | A | 5/2000 | Vinegar et al. |
| 6,079,499 | A | 6/2000 | Mikus et al. |
| 6,112,808 | A | 9/2000 | Isted |
| 6,148,602 | A | 11/2000 | Demetri |
| 6,148,911 | A | 11/2000 | Gipson et al. |
| 6,158,517 | A | 12/2000 | Hsu |
| 6,246,963 | B1 | 6/2001 | Cross et al. |
| 6,247,358 | B1 | 6/2001 | Dos Santos |
| 6,319,395 | B1 | 11/2001 | Kirkbride et al. |
| 6,328,104 | B1 | 12/2001 | Graue |
| 6,409,226 | B1 | 6/2002 | Slack et al. |
| 6,434,435 | B1 | 8/2002 | Tubel et al. |
| 6,434,436 | B1 | 8/2002 | Adamy et al. |
| 6,480,790 | B1 | 11/2002 | Calvert et al. |
| 6,540,018 | B1 | 4/2003 | Vinegar et al. |
| 6,547,956 | B1 | 4/2003 | Mukherjee et al. |
| 6,581,684 | B2 | 6/2003 | Wellington et al. |
| 6,585,046 | B2 | 7/2003 | Neuroth et al. |
| 6,589,303 | B1 | 7/2003 | Lokhandwale et al. |
| 6,591,906 | B2 | 7/2003 | Wellington et al. |
| 6,607,036 | B2 | 8/2003 | Ranson et al. |
| 6,609,735 | B1 | 8/2003 | DeLange et al. |
| 6,609,761 | B1 | 8/2003 | Ramey et al. |
| 6,659,650 | B2 | 12/2003 | Joki et al. |
| 6,659,690 | B1 | 12/2003 | Abadi |

(56) References Cited

U.S. PATENT DOCUMENTS 6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,740,226 B2 5/2004 Mehra et al.
6,742,588 B2 6/2004 Wellington et al.
6,745,831 B2 6/2004 De Rouffignac et al.
6,745,832 B2 6/2004 Wellington et al.
6,745,837 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Surgarmen et al.
6,854,929 B2 2/2005 Vinegar et al.
6,858,049 B2 2/2005 Mittricker
6,877,555 B2 4/2005 Karanikas et al.
6,880,633 B2 4/2005 Wellington et al.
6,887,369 B2 5/2005 Moulton et al.
6,896,053 B2 5/2005 Berchenko et al.
6,896,707 B2 5/2005 O'Rear et al.
6,913,078 B2 7/2005 Shahin et al.
6,915,850 B2 7/2005 Vinegar et al.
6,918,442 B2 7/2005 Wellington et al.
6,918,443 B2 7/2005 Wellington et al.
6,918,444 B2 7/2005 Passey et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,991,032 B2 1/2006 Berchenko et al.
6,991,033 B2 1/2006 Wellington et al.
6,994,160 B2 2/2006 Wellington et al.
6,994,169 B2 2/2006 Zhang et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,004,985 B2 2/2006 Wallace et al.
7,011,154 B2 3/2006 Maher et al.
7,013,972 B2 3/2006 Vinegar et al.
7,028,543 B2 4/2006 Hardage et al.
7,032,660 B2 4/2006 Vinegar et al.
7,036,583 B2 5/2006 de Rouffignac et al.
7,040,397 B2 5/2006 Rouffignac et al.
7,040,399 B2 5/2006 Wellington et al.
7,043,920 B2 5/2006 Viteri et al.
7,048,051 B2 5/2006 McQueen
7,051,807 B2 5/2006 Vinegar et al.
7,051,811 B2 5/2006 Rouffignac et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,090,013 B2 8/2006 Wellington
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,103,479 B2 9/2006 Patwardhan et al.
7,104,319 B2 9/2006 Vinegar et al.
7,121,341 B2 10/2006 Vinegar et al.
7,121,342 B2 10/2006 Vinegar et al.
7,124,029 B2 10/2006 Jammes et al.
7,143,572 B2 12/2006 Ooka et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,255,727 B2 8/2007 Monereau et al.
7,322,415 B2 1/2008 de St. Remey
7,331,385 B2 2/2008 Symington et al.
7,353,872 B2 4/2008 Sandberg
7,357,180 B2 4/2008 Vinegar et al.
7,405,243 B2 7/2008 Lowe et al.
7,441,603 B2 10/2008 Kaminsky et al.
7,461,691 B2 12/2008 Vinegar et al.
7,472,748 B2 1/2009 Gdanski et al.
7,484,561 B2 2/2009 Bridges
7,516,785 B2 4/2009 Kaminsky
7,516,786 B2 4/2009 Dallas et al.
7,516,787 B2 4/2009 Kaminsky
7,546,873 B2 6/2009 Kim et al.
7,549,470 B2 6/2009 Vinegar et al.
7,556,095 B2 7/2009 Vinegar
7,591,879 B2 9/2009 Sundaram et al.
7,604,054 B2 10/2009 Hocking
7,617,869 B2 11/2009 Carney
7,631,691 B2 12/2009 Symington et al.
7,637,984 B2 12/2009 Adamopoulos
7,644,993 B2 1/2010 Kaminsky et al.
7,647,971 B2 1/2010 Kaminsky
7,647,972 B2 1/2010 Kaminsky
7,654,320 B2 2/2010 Payton
7,669,657 B2 3/2010 Symington et al.
7,743,826 B2 6/2010 Harris et al.
7,798,221 B2 9/2010 Vinegar et al.
7,832,483 B2 11/2010 Trent
7,857,056 B2 12/2010 Kaminsky et al.
7,860,377 B2 12/2010 Vinegar et al.
7,905,288 B2 3/2011 Kinkead
8,087,460 B2 1/2012 Kaminsky
8,127,865 B2 3/2012 Watson et al.
8,176,982 B2 5/2012 Gil et al.
8,356,935 B2 1/2013 Arora et al.
8,540,020 B2 9/2013 Stone et al.
8,596,355 B2 12/2013 Kaminsky et al.
8,608,249 B2 12/2013 Vinegar et al.
8,616,280 B2 12/2013 Kaminsky et al.
8,622,127 B2 1/2014 Kaminsky
8,662,175 B2 3/2014 Karanikas et al.
2001/0049342 A1 12/2001 Passey et al.
2002/0013687 A1 1/2002 Ortoleva
2002/0023751 A1 2/2002 Neuroth et al.
2002/0029882 A1 3/2002 Rouffignac et al.
2002/0049360 A1 4/2002 Wellington et al.
2002/0056665 A1 5/2002 Zeuthen et al.
2002/0077515 A1 6/2002 Wellington et al.
2002/0099504 A1 7/2002 Cross et al.
2003/0070808 A1 4/2003 Allison
2003/0080604 A1 5/2003 Vinegar et al.
2003/0085570 A1 5/2003 Ernst et al.
2003/0111223 A1 6/2003 Rouffignac et al.
2003/0131994 A1 7/2003 Vinegar et al.
2003/0131995 A1 7/2003 de Rouffignac et al.
2003/0141067 A1 7/2003 Rouffignac et al.
2003/0178195 A1 9/2003 Agee et al.
2003/0183390 A1 10/2003 Veenstra et al.
2003/0192691 A1 10/2003 Vinegar et al.
2003/0196788 A1 10/2003 Vinegar et al.
2003/0196789 A1 10/2003 Wellington
2003/0209348 A1 11/2003 Ward et al.
2003/0213594 A1 11/2003 Wellington et al.
2004/0020642 A1 2/2004 Vinegar et al.
2004/0040715 A1 3/2004 Wellington et al.
2004/0140095 A1 7/2004 Vinegar et al.
2004/0198611 A1 10/2004 Atkinson
2004/0200618 A1 10/2004 Piekenbrock

(56) References Cited

U.S. PATENT DOCUMENTS

| | | | |
|---|---|---|---|
| 2004/0211557 | A1 | 10/2004 | Cole et al. |
| 2005/0051327 | A1 | 3/2005 | Vinegar et al. |
| 2005/0194132 | A1 | 9/2005 | Dudley et al. |
| 2005/0211434 | A1 | 9/2005 | Gates et al. |
| 2005/0211569 | A1 | 9/2005 | Botte et al. |
| 2005/0229491 | A1 | 10/2005 | Loffler |
| 2005/0252656 | A1 | 11/2005 | Maguire |
| 2005/0252832 | A1 | 11/2005 | Doyle et al. |
| 2005/0252833 | A1 | 11/2005 | Doyle et al. |
| 2005/0269077 | A1 | 12/2005 | Sandberg |
| 2005/0269088 | A1 | 12/2005 | Vinegar et al. |
| 2006/0021752 | A1 | 2/2006 | de St. Remey |
| 2006/0100837 | A1 | 5/2006 | Symington et al. |
| 2006/0102345 | A1 | 5/2006 | McCarthy et al. |
| 2006/0106119 | A1 | 5/2006 | Guo et al. |
| 2006/0199987 | A1 | 9/2006 | Kuechler et al. |
| 2006/0213657 | A1 | 9/2006 | Berchenko et al. |
| 2007/0000662 | A1 | 1/2007 | Symington et al. |
| 2007/0023186 | A1 | 2/2007 | Kaminsky et al. |
| 2007/0045265 | A1 | 3/2007 | McKinzie, II |
| 2007/0045267 | A1 | 3/2007 | Vinegar et al. |
| 2007/0084418 | A1 | 4/2007 | Gurevich |
| 2007/0095537 | A1 | 5/2007 | Vinegar |
| 2007/0102359 | A1 | 5/2007 | Lombardi et al. |
| 2007/0131415 | A1 | 6/2007 | Vinegar et al. |
| 2007/0137869 | A1 | 6/2007 | MacDougall et al. |
| 2007/0144732 | A1 | 6/2007 | Kim et al. |
| 2007/0209799 | A1 | 9/2007 | Vinegar et al. |
| 2007/0246994 | A1 | 10/2007 | Kaminsky et al. |
| 2008/0087420 | A1 | 4/2008 | Kaminsky et al. |
| 2008/0087421 | A1 | 4/2008 | Kaminsky |
| 2008/0087422 | A1 | 4/2008 | Kobler et al. |
| 2008/0087426 | A1 | 4/2008 | Kaminsky |
| 2008/0087427 | A1 | 4/2008 | Kaminsky et al. |
| 2008/0087428 | A1 | 4/2008 | Symington et al. |
| 2008/0127632 | A1 | 6/2008 | Finkenrath |
| 2008/0173442 | A1 | 7/2008 | Vinegar |
| 2008/0173443 | A1 | 7/2008 | Symington et al. |
| 2008/0185145 | A1 | 8/2008 | Carney et al. |
| 2008/0207970 | A1 | 8/2008 | Meurer et al. |
| 2008/0230219 | A1 | 9/2008 | Kaminsky |
| 2008/0271885 | A1 | 11/2008 | Kaminsky |
| 2008/0277317 | A1 | 11/2008 | Touffait et al. |
| 2008/0283241 | A1 | 11/2008 | Kaminsky et al. |
| 2008/0289819 | A1 | 11/2008 | Kaminsky et al. |
| 2008/0290719 | A1 | 11/2008 | Kaminsky et al. |
| 2008/0314593 | A1 | 12/2008 | Vinegar et al. |
| 2009/0032251 | A1 | 2/2009 | Cavender et al. |
| 2009/0038795 | A1 | 2/2009 | Kaminsky et al. |
| 2009/0050319 | A1 | 2/2009 | Kaminsky et al. |
| 2009/0101346 | A1 | 4/2009 | Vinegar et al. |
| 2009/0101348 | A1 | 4/2009 | Kaminsky |
| 2009/0107679 | A1 | 4/2009 | Kaminsky |
| 2009/0133935 | A1 | 5/2009 | Kinkead |
| 2009/0145598 | A1 | 6/2009 | Symington et al. |
| 2009/0200290 | A1 | 8/2009 | Cardinal et al. |
| 2009/0211754 | A1 | 8/2009 | Verret et al. |
| 2009/0308608 | A1 | 12/2009 | Kaminsky et al. |
| 2010/0038083 | A1 | 2/2010 | Bicerano |
| 2010/0078169 | A1 | 4/2010 | Symington et al. |
| 2010/0089575 | A1 | 4/2010 | Kaminsky et al. |
| 2010/0089585 | A1 | 4/2010 | Kaminsky |
| 2010/0095742 | A1 | 4/2010 | Symington et al. |
| 2010/0101793 | A1 | 4/2010 | Symington et al. |
| 2010/0133143 | A1 | 6/2010 | Roes et al. |
| 2010/0218946 | A1 | 9/2010 | Symington et al. |
| 2010/0276983 | A1 | 11/2010 | Dunn et al. |
| 2010/0282460 | A1 | 11/2010 | Stone et al. |
| 2010/0307744 | A1 | 12/2010 | Cochet et al. |
| 2010/0314108 | A1 | 12/2010 | Crews et al. |
| 2010/0319909 | A1 | 12/2010 | Symington et al. |
| 2011/0000221 | A1 | 1/2011 | Minta et al. |
| 2011/0000671 | A1 | 1/2011 | Hershkowitz |
| 2011/0100873 | A1 | 5/2011 | Viets et al. |
| 2011/0146981 | A1 | 6/2011 | Diehl |
| 2011/0146982 | A1 | 6/2011 | Kaminsky et al. |
| 2011/0186295 | A1 | 8/2011 | Kaminsky et al. |
| 2011/0247809 | A1 | 10/2011 | Lin et al. |
| 2011/0257944 | A1 | 10/2011 | Du et al. |
| 2011/0290490 | A1 | 12/2011 | Kaminsky et al. |
| 2011/0309834 | A1 | 12/2011 | Homan et al. |
| 2012/0012302 | A1 | 1/2012 | Vogel et al. |
| 2012/0267110 | A1 | 10/2012 | Meurer et al. |
| 2012/0325458 | A1 | 12/2012 | El-Rabaa et al. |
| 2013/0043029 | A1 | 2/2013 | Vinegar et al. |
| 2013/0106117 | A1 | 5/2013 | Sites |
| 2013/0112403 | A1 | 5/2013 | Meurer et al. |
| 2013/0277045 | A1 | 10/2013 | Parsche |
| 2013/0292114 | A1 | 11/2013 | Lin et al. |
| 2013/0292177 | A1 | 11/2013 | Meurer et al. |
| 2013/0319662 | A1 | 12/2013 | Alvarez et al. |

FOREIGN PATENT DOCUMENTS

| | | |
|---|---|---|
| CA | 2377467 | 1/2001 |
| CA | 2560223 | 3/2007 |
| EP | 0387846 | 9/1990 |
| EP | 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| GB | 2430454 | 3/2007 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 03/035811 | 5/2003 |
| WO | WO 2005/010320 | 2/2005 |
| WO | WO 2005/045192 | 5/2005 |
| WO | WO 2005/091883 | 10/2005 |
| WO | WO 2006/115943 | 11/2006 |
| WO | WO 2007/033371 | 3/2007 |
| WO | WO 2007/050445 | 5/2007 |
| WO | WO 2007/050479 | 5/2007 |
| WO | WO 2010/011402 | 1/2010 |
| WO | WO 2010/047859 | 4/2010 |
| WO | WO 2011/116148 | 9/2011 |
| WO | WO 2011/153339 | 12/2011 |
| WO | WO 2014/028834 | 2/2014 |

OTHER PUBLICATIONS

ASTM D5762 12 "Standard Test Method for Nitrogen in Petroleum and Petroleum Products by Boat Inlet Chemiluminescence". (Retrieved Dec. 19, 2014).

Ali, A.H.A, et al, (2003) "Watching Rocks Change-Mechanical Earth Modeling", *Oilfield Review*, pp. 22-39.

Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.

Anderson, R., et al (2003) "Power Generation with 100% Carbon Capture Sequestration" 2nd Annual Conference on Carbon Sequestration, Alexandria, VA.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 1-92.

(56) References Cited

OTHER PUBLICATIONS

Baugman, G. L. (1978) *Synthetic Fuels Data Handbook*, Second Edition, Cameron Engineers Inc. pp. 3-145.
Berry, K. L., et al. (1982) "Modified in situ retorting results of two field retorts", Gary, J. H., ed., 15th Oil Shale Symp., CSM, pp. 385-396.
Blanton, T. L. et al, (1999) "Stress Magnitudes from Logs: Effects of Tectonic Strains and Temperature", *SPE Reservoir Eval. & Eng. 2*, vol. 1, February, pp. 62-68.
Bondarenko, S.T., et al., (1959) "Application of electrical current for direct action on a seam of fuel in shaftless underground gasification," Academy of Sciences of the USSR, Translated for Lawrence Livermore Laboratory by Addis Translations International in Mar. 1976, pp. 25-41.
Boyer, H. E. et al. (1985) "Chapter 16: Heat-Resistant Materials," *Metals Handbook*, American Society for Metals, pp. 16-1-16-26.
Brandt, A. R., (2008) "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Bridges, J.E., (2007) "Wind Power Energy Storage for In Situ Shale Oil Recovery With Minimal CO2 Emissions", IEEE Transactions on Energy Conversion, vol. 22, No. 1 Mar. 2007, pp. 103-109.
Burnham, A. K. et al. (1983) "High-Pressure Pyrolysis of Green River Oil Shale" in Geochemistry and Chemistry of Oil Shales: ACS Symposium Series, pp. 335-351.
Burwell, E. L. et al. (1970) "Shale Oil Recovery by In-Situ Retorting—A Pilot Study" Journal of Petroleum Engr., Dec. 1970, pp. 1520-1524.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Chute, F. S., and Vermeulen, F. E., (1988) "Present and potential applications of electromagnetic heating in the in situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cipolla, C.L., et al. (1994), "Practical Application of in-situ Stress Profiles", *Society of Petroleum Engineers*, SPE 28607, pp. 487-499.
Cook, G. L. et al. (1968) "The Composition of Green River Shale Oils" United Nations Symposium of the Development and Utilization of Oil Shale Resources, pp. 3-23.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) Thermal Degradation of Green River Kerogen at 150 to 350C: Rate of Product Formation, Report of Investigation 7620, *US Bureau of Mines*, 1972, pp. 1-15.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jrnl. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, pp. 465-481.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P., et al. (1979) "Partitioning of major, minor, and trace elements during simulated in situ oil shale retorting in a controlled-state retort", Twelfth Oil Shale Symposium Proceedings, Colorado School of Mines, Golden Colorado, Apr. 18-20, 1979.
Fox, J. P, (1980) "Water Quality Effects of LeachatesFrom an In-Situ Oil Shale Industry," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garland, T. R., et al. (1979) "Influence of irrigation and weathering reactions on the composition of percolates from retorted oil shale in field lysimeters", Twelfth Oil Shale Symposium Proceedings, Colorado School of Mines, Golden Colorado, Apr. 18-20, 1979, pp. 52-57.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, Aug. pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.

(56) References Cited

OTHER PUBLICATIONS

Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-86 and 89-91.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Kilkelly, M. K., et al. (1981), "Field Studies on Paraho Retorted Oil Shale Lysimeters: Leachate, Vegetation, Moisture, Salinity and Runoff, 1977-1980", prepared for Industrial Environmental Research Laboratory, U. S. Environmental Protection Agency, Cincinnati, OH.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-8.
Moschovidis, Z. (1989) "Interwell Communication by Concurrent Fracturing—a New Stimulation Technique", *Journ. of Canadian Petro. Tech*. 28(5), pp. 42-48.
Motzfeldt, K. (1954) "The Thermal Decomposition of Sodium Carbonate by the Effusion Method," *Jrnl. Phys. Chem*., v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem*., 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nordin, J. S, et al. (1988), "Groundwater studies at Rio Blanco Oil Shale Company's retort 1 at Tract C-a", DOE/MC/11076-2458.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp. pp. 4-23, 80-83 & 160-183.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Poulson, R. E., et al. (1985), "Organic Solute Profile of Water from Rio Blanco Retort 1", DOE/FE/60177-2366.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol*., pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from internet: URL:http://www.reade.com/Particle%5FBriefings/elec%5Fres.html.
Rio Blanco Oil Shale Company, (1986), "MIS Retort Abandonment Program" Jun. 1986 Pumpdown Operation.
Riva, D. et al. (1998) "Suncor down under: the Stuart Oil Shale Project", Annual Meeting of the *Canadian Inst. of Mining, Metallurgy, and Petroleum*, Montreal, May 3-7.

(56) References Cited

OTHER PUBLICATIONS

Robson, S. G. et al., (1981), "Hydrogeochemistry and simulated solute transport, Piceance Basin, northwestern Colorado", U. S. G. S. Prof. Paper 1196.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom In Situ Method for Shale-Oil Recovery," 2nd *Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stanford University, (2008) "Transformation of Resources to Reserves: Next Generation Heavy-Oil Recovery Techniques", Prepared for U.S. Department of Energy, National Energy Technology Laboratory, DOE Award No. DE-FC26-04NT15526, Mar. 28, 2008.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) "ExxonMobil's electrofrac process for in situ oil shale conversion," 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Taylor, O. J., (1987), "Oil Shale, Water Resources and Valuable Minerals of the Piceance Basin, Colorado: The Challenge and Choices of Development". U. S. Geol. Survey Prof. Paper 1310, pp. 63-76.
Templeton, C. C. (1978) "Pressure-Temperature Relationship for Decomposition of Sodium Bicarbonate from 200 to 600° F.," *J. of Chem. And Eng. Data*, 23(1), pp. 7-8.
Thomas, A. M. (1963) "Thermal Decomposition of Sodium Carbonate Solutions," *J. of Chem. And Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations* 7576, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-198 and 254-266.
Tissot, B. P., and Welte, D. H. (1984) *Petroleum Formation and Occurrence*, New York, Springer-Verlag, p. 267-289 and 470-492.
Turta, A., (1994), "In situ combustion—from pilot to commercial application", *DOE/NIPER Symposium on In Situ Combustion Practices-Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: SPE Reprint Series No. 28", *Soc. of Petroleum Engineers* SPE 14085, Part I, Overview, pp. 12-44.
Vermeulen, F.E., et al. (1983) "Electromagnetic Techniques in the In-Situ Recovery of Heavy Oils", *Journal of Microwave Power*, 18(1) pp. 15-29.
Warpinski, N.R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 215-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" (4th ed.), *Alkali and Chlorine Products*, pp. 1025-1039 (1998).
Braun, R.L. et al. (1990) "Mathematical model of oil generation, degradation, and expulsion," Energy Fuels, vol. 4, No. 2, pp. 132-146.
Burnham, A.K. (1979) "Reaction kinetics between CO2 and oil-shale residual carbon 1. Effect of heating rate on reactivity," Fuel, vol. 58, pp. 285-292.
Campbell, J.H. (1978) "Kinetics of decomposition of Colorado oil shale II. Carbonate minerals," Lawrence Livermore Laboratory UCRL-52089.
Duba, A.G. (1977) "Electrical conductivity of coal and coal char," Fuel, vol. 56, pp. 441-443.
Duba, A. (1983) "Electrical conductivity of Colorado oil shale to 900C," Fuel, vol. 62, pp. 966-972.
Pope, M.I. et al. (1961) "The specific electrical conductivity of coals," Fuel, vol. 40, pp. 123-129.

SYSTEMS AND METHODS FOR REGULATING AN IN SITU PYROLYSIS PROCESS

CROSS-REFERENCE TO RELATED APPLICATION

This application claims the priority benefit of U.S. Provisional Patent Application 61/894,295 filed Oct. 22, 2013 entitled Systems and Methods for Regulating an In Situ Pyrolysis Process, the entirety of which is incorporated by reference herein.

FIELD

The present disclosure is directed generally to systems and methods for regulating an in situ pyrolysis process, and more particularly to systems and methods that monitor a composition of a product fluid stream and regulate the in situ pyrolysis process based upon the composition of the product fluid stream.

BACKGROUND

Certain subterranean formations contain organic matter that cannot readily be produced by pumping and/or flowing from the subterranean formation. This organic matter may be a solid, may be captured within a rock matrix, and/or may have a viscosity that precludes flow from the subterranean formation (at least at economically viable flow rates). Such organic matter may include kerogen, bitumen, and/or coal.

Often, it may be desirable to convert this organic matter to a form that may be produced from the subterranean formation by flowing the converted organic matter from the subterranean formation. One approach to this conversion is in situ pyrolysis of the organic matter to generate a product fluid stream with a viscosity that is sufficiently low to permit production via flow of the product fluid stream from the subterranean formation. In situ pyrolysis involves heating the organic matter within the subterranean formation to increase a decomposition rate of the organic matter, thereby generating the product fluid stream.

In situ pyrolysis may occur many hundreds, or even thousands, of feet from a surface site that facilitates the in situ pyrolysis process and/or that is configured to receive the product fluid stream. In addition, it often may take days, weeks, or event months for the product fluid stream, once generated, to be produced from the subterranean formation. As such, it may be difficult to regulate the in situ pyrolysis process, to determine a temperature of an active pyrolysis region that is generating the product fluid stream, and/or to determine a location of the active pyrolysis region. Thus, there exists a need for improved systems and methods for regulating an in situ pyrolysis process.

SUMMARY

A method of regulating a pyrolyzed fluid production system that is configured to produce a product fluid stream from organic matter within a subterranean formation. The method may comprise producing the product fluid stream from an active pyrolysis region within the subterranean formation via a production well that extends between a surface region and the subterranean formation. The method also may comprise detecting a concentration of a first component in the product fluid stream, with the concentration of the first component being indicative of an intensive property of the pyrolyzed fluid production system. The method also may comprise detecting a concentration of a second component in the product fluid stream, with the concentration of the second component being indicative of an extensive property of the pyrolyzed fluid production system. The method also may comprise regulating at least one characteristic of the pyrolyzed fluid production system based, at least in part, on the concentration of the first component and on the concentration of the second component.

A method of regulating a temperature of an active pyrolysis region within a subterranean formation. The method may comprise supplying thermal energy to the subterranean formation to heat the active pyrolysis region of the subterranean formation and to generate a product fluid stream therefrom. The method also may comprise producing the product fluid stream from the subterranean formation via a production well that extends between a surface region and the subterranean formation. The method also may comprise detecting a concentration of a temperature-sensitive component in the product fluid stream, with the concentration of the temperature-sensitive component being indicative of a temperature of the active pyrolysis region. The method also may comprise regulating a rate of the supplying thermal energy based, at least in part, on the concentration of the temperature-sensitive component.

The foregoing has broadly outlined the features of the present disclosure so that the detailed description that follows may be better understood. Additional features will also be described herein.

Figure 1:
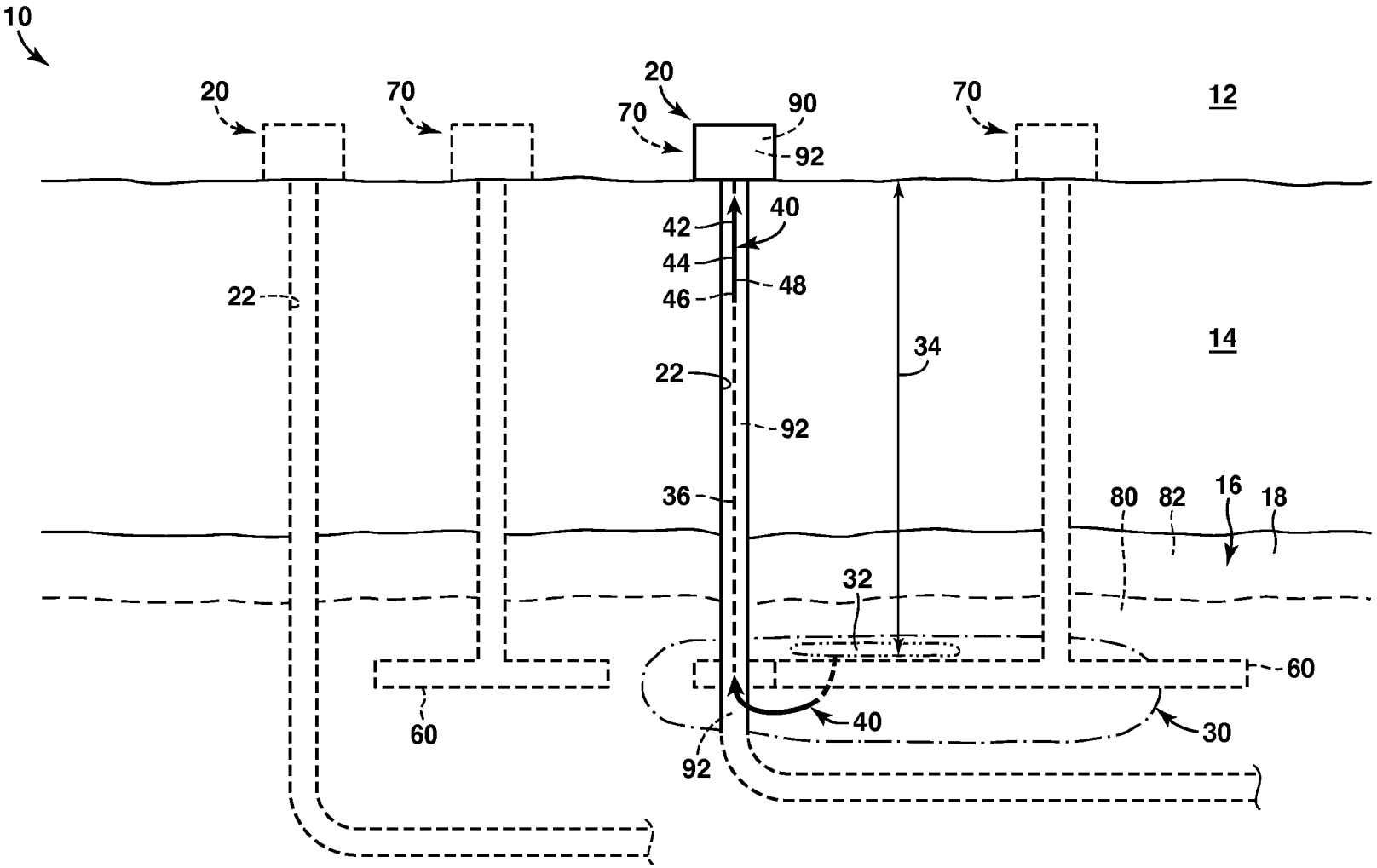
FIG. 1 is a schematic representation of a pyrolyzed fluid production system.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

For the purpose of promoting an understanding of the principles of the disclosure, reference will now be made to the features illustrated in the drawings, and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. It will be apparent to those skilled in the relevant art that some features that are not relevant to the present disclosure may not be shown in the drawings for the sake of clarity.

Figure 2:
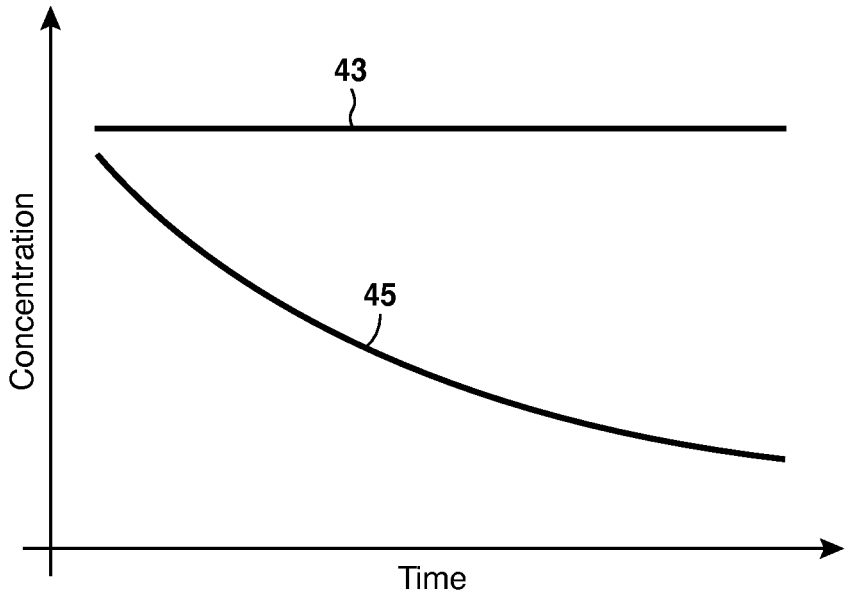
FIG. 2 is a plot depicting concentration vs. time for two different components that may be present within a product fluid stream.
Figure 3:
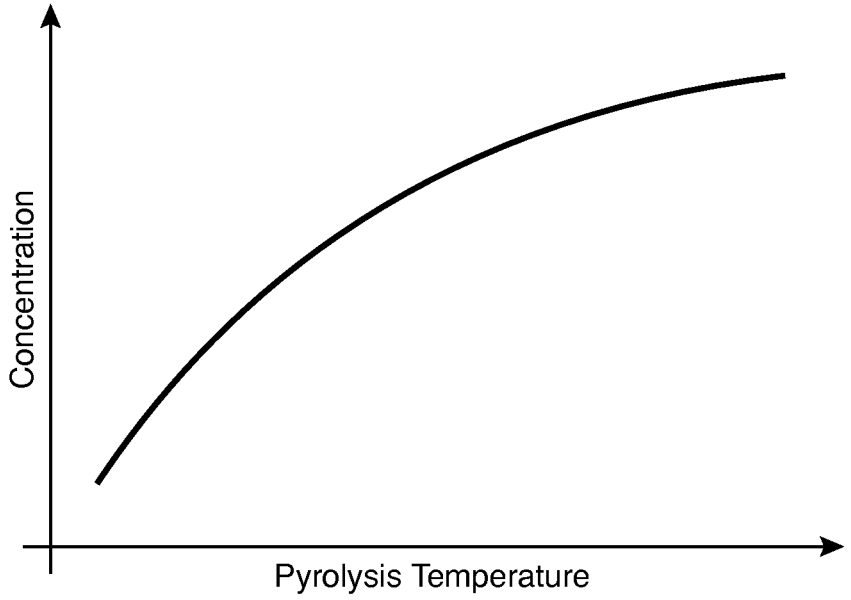
FIG. 3 is a plot depicting concentration vs. pyrolysis temperature for a component that may be present within the product fluid stream.

FIG. 1 provides examples of a pyrolyzed fluid production system 10 that may include and/or utilize the systems and methods according to the present disclosure. FIGS. 2-3 provide examples of concentration profiles that may be obtained from pyrolyzed fluid production system 10. In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

FIG. 1 is a schematic representation of a pyrolyzed fluid production system 10. Pyrolyzed fluid production system 10 also may be referred to herein as a pyrolysis system 10 and/or as a system 10. System 10 may include one or more production wells 20 that may include wellbore(s) 22. Wellbore(s) 22 may extend between a surface region 12 and a subterranean formation 16 within a subsurface region 14. Subterranean formation 16 may include organic matter 18, which may be located within one or more strata, such as a first strata 80 and/or a second strata 82 (as schematically illustrated in dashed lines in FIG. 1) of the subterranean formation.

Pyrolyzed fluid production system 10 may include one or more heating assemblies 60. Heating assemblies 60 may receive thermal energy from one or more thermal energy supply wells 70. The thermal energy supply wells 70 may be separate from and/or may be coextensive with production wells 20. Heating assemblies 60 may be located within subterranean formation 16. Heating assemblies 60 may be configured to heat the subterranean formation to generate a pyrolyzed zone 30 (as illustrated in dash-dot lines).

At a given point in time, pyrolyzed zone 30 of pyrolyzed fluid production system 10 may include at least one active pyrolysis region 32 (as illustrated in dash-dot-dot lines). The one or more heating assemblies 60 may heat active pyrolysis region 32 such that organic matter 18 ages, is decomposed, breaks down, and/or is otherwise converted to a product fluid stream 40. Product fluid stream 40 then may flow via a representative flow path 36 through production well 20 to surface region 12. Representative flow path 36 may define a representative flow distance for product fluid stream 40.

Each active pyrolysis region 32 may encompass a finite, non-zero, volume within subterranean formation 16. As such, product fluid stream 40 may not be generated at a single point, or location, within subterranean formation 16 but instead may be generated at a plurality of different locations. Thus, representative flow path 36 may define an average, nominal, and/or composite flow path for product fluid stream 40. Representative flow path 36 also may be referred to herein as an average flow path 36, a nominal flow path 36, and/or a composite flow path 36. Similarly, the representative flow distance also may be referred to herein as an average flow distance, a nominal flow distance, and/or a composite flow distance.

Pyrolyzed fluid production system 10 may include a controller 90. Controller 90 may be adapted, configured, designed, selected, and/or programmed to control the operation of at least a portion of pyrolyzed fluid production system 10.

Pyrolyzed fluid production system 10 may include one or more detectors 92. Detectors 92 may be present at any suitable location within pyrolyzed fluid production system 10, such as within surface region 12, within wellbore 22, and/or within subterranean formation 16. Detectors 92 may be configured to detect any suitable property, parameter, and/or variable that may be associated with and/or representative of pyrolyzed fluid production system 10.

Pyrolyzed zone 30 may include any suitable portion of subterranean formation 16. For example, pyrolyzed zone 30 may include a portion of subterranean formation 16 that has been heated by the one or more heating assemblies 60 to at least a threshold pyrolysis temperature. Pyrolyzed zone 30 also may include a portion of subterranean formation 16 that has had at least a portion of organic matter 18 that was originally contained therein (i.e., prior to being heated by heating assembly 60) converted to product fluid stream 40.

Active pyrolysis region 32 may include any suitable portion of pyrolyzed zone 30 that is currently, presently, or actively, generating product fluid stream 40. Immediately subsequent to formation of pyrolyzed fluid production system 10 and/or during initial heating of subterranean formation 16, active pyrolysis region 32 may be substantially the same size as pyrolyzed zone 30, may be substantially coextensive with pyrolyzed zone 30, and/or may be pyrolyzed zone 30. However, and subsequent to heating subterranean formation 16 for at least a threshold time, a portion of pyrolyzed zone 30 may be depleted, or at least substantially depleted, of organic matter 18. When a portion of pyrolyzed zone 30 is depleted of organic matter 18, active pyrolysis region 32 may define, or be located within, a peripheral region, outer region, and/or edge region of pyrolyzed zone 30 and/or may form an interface 38 between pyrolyzed zone 30 and subterranean formation 16.

As active pyrolysis region 32 moves, or migrates, away from the one or more heating assemblies 60, it may be difficult to accurately measure, or determine, a temperature of the active pyrolysis region 32. However, regulating the temperature of the active pyrolysis region 32 may be beneficial. For example, regulating the temperature of the active pyrolysis region 32 may permit improved generation and/or production of product fluid stream 40. The disclosed systems and methods may be utilized to measure, calculate, model, and/or predict a representative temperature of active pyrolysis region 32.

As previously discussed, active pyrolysis region 32 may define a finite volume within subterranean formation 16. The temperature, pressure, and/or stress within active pyrolysis region 32 may vary with location. The representative temperature may include and/or be any suitable average temperature, nominal temperature, and/or composite temperature of the active pyrolysis region. Similarly, the representative pressure may include and/or be any suitable average pressure, nominal pressure, and/or composite pressure within the active pyrolysis region. In addition, the effective stress may include and/or be any suitable average stress, nominal stress, and/or composite stress on the material within the active pyrolysis region.

Similarly, and as active pyrolysis region 32 moves, or migrates, away from heating assembly 60, it may be difficult to accurately measure, or determine, a location of active pyrolysis region 32, a representative distance between active pyrolysis region 32 and production well 20, a representative distance between active pyrolysis region 32 and surface region 12 (such as may be measured by a length of representative flow path 36), a representative depth 34 of active pyrolysis region 32, and/or a representative flow speed (or flow velocity) of product fluid stream 40 within subterranean formation 16. However, knowledge of this location, representative distance, and/or representative flow speed (or flow velocity) may be beneficial, for example by assisting in and/or enabling more accurate modeling of flow properties within subterranean formation 16. This knowledge also may aid in determining whether additional intervention activities, such as fracturing of subterranean formation 16, will improve a production rate of product fluid stream 40. The disclosed systems and methods may be utilized to measure, calculate, model, and/or predict the location of active pyrolysis region 32, the representative distance between active pyrolysis region 32 and production well 20 (and/or surface region 12) and/or the representative flow speed (or flow velocity) of product fluid stream 40 within subterranean formation 16. These representative properties also may be referred to herein as average, nominal, and/or composite properties.

The one or more heating assemblies 60 may include any suitable structure that may be configured to provide thermal energy, or heat, to at least a portion of subterranean formation 16 (such as to pyrolyzed zone 30 and/or to active pyrolysis region 32). For example, each heating assembly 60 may include any suitable electric heating assembly, such as a resistive heater and/or a granular resistive heater that is configured to heat the portion of subterranean formation 16 upon receipt of an electric current. Each heating assembly 60 may include any suitable combustion heating assembly, such as a burner, that is configured to heat the portion of subterranean formation 16 upon combustion of a fuel with an oxidant. Each heating assembly 60 may include any suitable heat exchange medium and/or heat exchange medium supply structure, such as a supply conduit that is configured to provide a heated fluid stream, such as a steam stream, to the portion of the subterranean formation.

FIG. 1 schematically illustrates heating assemblies 60 in dashed lines to indicate that heating assemblies 60 may be present within any suitable portion of subterranean formation 16 and/or to indicate that subterranean formation 16 may include any suitable number of heating assemblies 60. Thus, and as illustrated, heating assemblies 60 may be proximal to, may be adjacent to, may be located within, and/or may be at least partially coextensive with production well 20. Each heating assembly 60 may be spaced apart from production well 20.

Thermal energy supply well 70 may include any suitable structure that may provide thermal energy and/or potential energy that may be converted to thermal energy to heating assembly 60. Thermal energy supply well 70 also may permit transfer of the heat exchange medium from surface region 12 to heating assembly 60. Thermal energy supply well 70 may include any suitable electrical conduit, any suitable fuel supply conduit, any suitable oxidant supply conduit, and/or the heat exchange medium supply conduit. As illustrated, thermal energy supply well 70 may form a portion of, and/or may be at least partially coextensive with, production well 20. However, thermal energy supply well 70 also may be separate from, spaced apart from, and/or distinct from production well 20.

Production well 20 may include any suitable structure that may extend between surface region 12 and subterranean formation 16, such as wellbore 22. Production well 20 also may include any suitable structure that may be utilized as, or may contain, a fluid conduit that may convey product fluid stream 40 from subterranean formation 16 to surface region 12. For example, the production well 20 may include any suitable well, oil well, vertical well, horizontal well, pipe, tubing, valve, pump, and/or compressor.

Product fluid stream 40 may include, or be, any suitable fluid stream that may be generated through the heating, aging, decomposition, thermal break-down, and/or conversion of at least organic matter 18 within pyrolyzed zone 30. At the temperature and pressure of the pyrolysis zone, the product fluid stream may be all in the gas phase, but at other conditions, such as lower temperature conditions outside of the pyrolyzed zone, the product fluid stream may contain a combination of liquid components and gas components. As used herein, "fluid" is intended to refer generally to a flowable composition that may include gas-phase and/or liquid-phase components. Accordingly, the product fluid stream may include at least one gas, or gas-phase component, which also may be referred to herein as a product gas and/or as a produced gas. Similarly, the product fluid stream may include at least one liquid, or liquid-phase component, which also may be referred to herein as a product liquid and/or as a produced liquid. At elevated temperatures, such as which may be present in a pyrolyzed zone, some components of the product fluid stream may be in a vapor-phase, and thus may be referred to as a product vapor and/or as a produced vapor. However, these components may condense to a liquid, or liquid-phase, upon being exposed to temperatures and/or pressures that are present outside of the pyrolyzed zone, such as during transport to the surface region and/or at the surface region.

Product fluid stream 40 may include any suitable fluid with a viscosity that is sufficiently low to permit, or permit economic, production via production well 20. Conversion of organic matter 18 to product fluid stream 40 may generate, liberate, and/or release a plurality of different components. The plurality of different components may form a portion of product fluid stream 40 and/or may be produced via production well 20 with product stream 40.

As illustrated in FIG. 1, product fluid stream 40 may include a first component 42, a second component 44, one or more isotopes 46, and/or trace metals 48, each of which may comprise a single chemical species and/or a plurality of chemical species. The presence of these components, concentrations of these components, and/or a relative proportion of these components within product fluid stream 40 may be indicative of, or may be utilized to determine, one or more intensive properties and/or one or more extensive properties of a pyrolyzed fluid production system.

The pyrolyzed fluid production system may include and/or be pyrolyzed fluid production system 10. When the pyrolyzed fluid production system includes pyrolyzed fluid production system 10, the disclosed systems and methods may be utilized to regulate the operation of pyrolyzed fluid production system 10.

The pyrolyzed fluid production system may be another pyrolyzed fluid production system that is distinct from pyrolyzed fluid production system 10. When the pyrolyzed fluid production system is distinct from pyrolyzed fluid production system 10, the disclosed systems and methods may be utilized to regulate the operation, the design, the configuration, and/or the creation of the pyrolyzed fluid production system. The regulation of the operation, design, and/or creation of the pyrolyzed fluid production system may include, for example, regulating a physical layout of the pyrolyzed fluid production system, regulating a size, location, orientation, and/or trajectory of a production well that forms a portion of the pyrolyzed fluid production system, regulating a size, location, and/or configuration of a heating assembly that forms a portion of the pyrolyzed fluid production system, regulating a starting location for initial pyrolysis within a subterranean formation that includes the pyrolyzed fluid production system, and/or regulating a duration and/or temperature of heating within the subterranean formation.

As used herein, an intensive property may include any suitable property of a material that is not related to an amount, volume, or mass, of the material that is present. Intensive properties may include any suitable representative temperature of active pyrolysis region 32, representative pressure within active pyrolysis region 32, and/or effective stress on the material within active pyrolysis region 32. Conversely, and as used herein, an extensive property may include any suitable property of the material that is related to the amount, volume, or mass of the material that is present. Extensive properties may include any suitable representative heating rate of the material within the subterranean formation, representative product gas pressure within the subterranean formation, representative flow speed or velocity of the material within the subterranean formation, representative residence time of the material within the subterranean formation, and/or representative distance between the active pyrolysis region and a detector that is configured to detect the component.

First component 42 may be selected such that a concentration of first component 42 within product fluid stream 40 may be indicative of the intensive property of pyrolyzed fluid production system 10. To facilitate determination of the intensive property, first component 42 may include at least one material (i.e., a material or a plurality of materials) that is at least substantially stable, or unreactive, within product fluid stream 40. This is illustrated at 43 in FIG. 2, which is a plot of concentration vs. time. Thus, the concentration of first component 42, as measured by detector(s) 92, may be indicative of reaction conditions (i.e., temperature, pressure, and/or effective stress) within active pyrolysis region 32 and not of a time between formation of first component 42 and detection of first component 42.

First component 42 may be selected such that a half-life of first component 42 within product fluid stream 40 may be at least a threshold minimum half-life. Examples of the threshold minimum half-life are at least 1 month, at least 2 months, at least 3 months, at least 4 months, at least 5 months, at least 6 months, at least 7 months, at least 8 months, at least 9 months, at least 10 months, at least 11 months, at least 12 months, at least 14 months, at least 16 months, at least 18 months, at least 20 months, at least 22 months, at least 24 months, at least 30 months, at least 36 months, at least 58 months, at least 60 months, and/or within a range that includes or is bounded by any of the preceding examples of threshold minimum half-lives.

However, the concentration of first component 42 within product fluid stream 40 may be dependent upon, may vary with, and/or may be indicative of the intensive property. For example, FIG. 3 provides a schematic plot depicting concentration of first component 42 within product fluid stream 40 as a function of the temperature of active pyrolysis region 32. In FIG. 3, the concentration of first component 42 increases (or increases monotonically) with increasing temperature of active pyrolysis region 32. The illustrated functional relationship may be obtained when first component 42 is a sulfur-containing hydrocarbon, such as a sulfur-containing hydrocarbon ring, a thiophene, a benzothiophenen, and/or a dibenzothiophene. However, other first components 42 that exhibit a different functional relationship (such as decreasing in concentration with increasing temperature of active pyrolysis region 32) also may be selected, detected, and/or utilized with the disclosed systems and methods.

Second component 44 may be selected such that a concentration of second component 44 within product fluid stream 40 may be indicative of the extensive property of pyrolyzed fluid production system 10. To facilitate determination of the extensive property, second component 44 may include at least one material (i.e., a material or a plurality of materials) that is at least substantially unstable, or reactive, within product fluid stream 40. Thus, the concentration of second component 44 may change as a function of the elapsed time between formation of second component 44 and detection of second component 44, as illustrated in FIG. 2 at 45.

For example, second component 44 may be selected such that a half-life of second component 44 within product fluid stream 40 may be less than a threshold maximum half-life. Examples of the threshold maximum half-life are less than 6 months, less than 5 months, less than 4 months, less than 3 months, less than 2 months, less than 1 month, less than 15 days, within a range that is bounded by any of the preceding examples of threshold minimum half-lives, less than or equal to the elapsed time between formation of second component 44 and detection of second component 44, and/or less than or equal to the representative residence time of product fluid stream 40 within subterranean formation 16.

In FIG. 2, the concentration of second component 44, as illustrated at 45, decreases (or decreases monotonically) with time. The illustrated functional relationship may be obtained when second component 44 is a nitrogen-containing hydrocarbon, such as a nitrogen-containing hydrocarbon ring, a pyridine, a quinoline, a pyrrole, an indole, and/or a carbazole. However, other second components 44 that exhibit a different functional relationship (such as increasing in concentration with increasing time) also may be selected, detected, and/or utilized with the disclosed systems and methods.

Returning to FIG. 1, different strata within subterranean formation 16, such as first strata 80 and/or second strata 82, may include different isotopic compositions. Also, different isotopes may partition between product fluid stream 40 and organic and/or inorganic materials that remain within subterranean formation 16 subsequent to generation of product fluid stream 40 in different proportions depending upon the composition of the organic and/or inorganic materials within the subterranean formation. As such, measuring and/or detecting the isotopic composition of product fluid stream 40 may provide additional information regarding the location of active pyrolysis region 32 and/or regarding movement, or migration, of active pyrolysis region 32 within subterranean formation 16.

As an example, a change in isotopic composition of one or more elements that may be present within product fluid stream 40 may indicate that active pyrolysis region 32 has moved from first strata 80 to second strata 82. An isotopic composition of sulfur within product fluid stream 40 may be utilized to determine a composition of the organic and/or inorganic materials that remain within subterranean formation 16 subsequent to generation of product fluid stream 40. An isotopic composition of oxygen and/or carbon within liquids and/or gasses that comprise product fluid stream 40 may be utilized to determine a proportion of the gasses that are generated by decomposition of an inorganic species and/or a proportion of the gasses that are generated by pyrolysis of an organic species.

Similar to isotopes 46, trace metals 48 of differing concentration and/or composition may be distributed within subterranean formation 16. As such, and if a trace metal distribution within the subterranean formation is already known and/or determined, the concentration of these trace metals 48 within subterranean formation 16 may be utilized to estimate and/or determine the location of active pyrolysis region 32.

Subterranean formation 16 may include and/or be any suitable subterranean formation that may include organic matter 18, isotopes 46, and/or trace metals 48. Subterranean formation 16 also may include any suitable subterranean formation that may be heated and/or pyrolyzed to generate product fluid stream 40. For example, subterranean formation 16 may include and/or be an oil sands formation, an oil shale formation, and/or a coal formation. Organic matter 18 may include and/or be any suitable organic matter. For example, organic matter 18 may include and/or be bitumen, kerogen, and/or coal.

Controller 90, when present, may include any suitable structure that may be adapted, configured, designed, selected, and/or programmed to control the operation of at least a portion of pyrolyzed fluid production system 10. This structure may include controlling the operation of the pyrolyzed fluid production system using methods 100 of FIG. 4. For example, controller 90 may include and/or be an automated controller, an electronic controller, a programmable controller, a dedicated controller, and/or a computer.

Detector(s) 92 may include any suitable structure that may be adapted and/or configured to detect any suitable property of product fluid stream 40. For example, detector(s) 92 may detect the concentration of first component 42, the concentration of second component 44, the isotopic composition of isotopes 46, and/or the composition and/or concentration of trace metals 48. For example, detector(s) 92 may include or may be a spectrometer.

Figure 4:
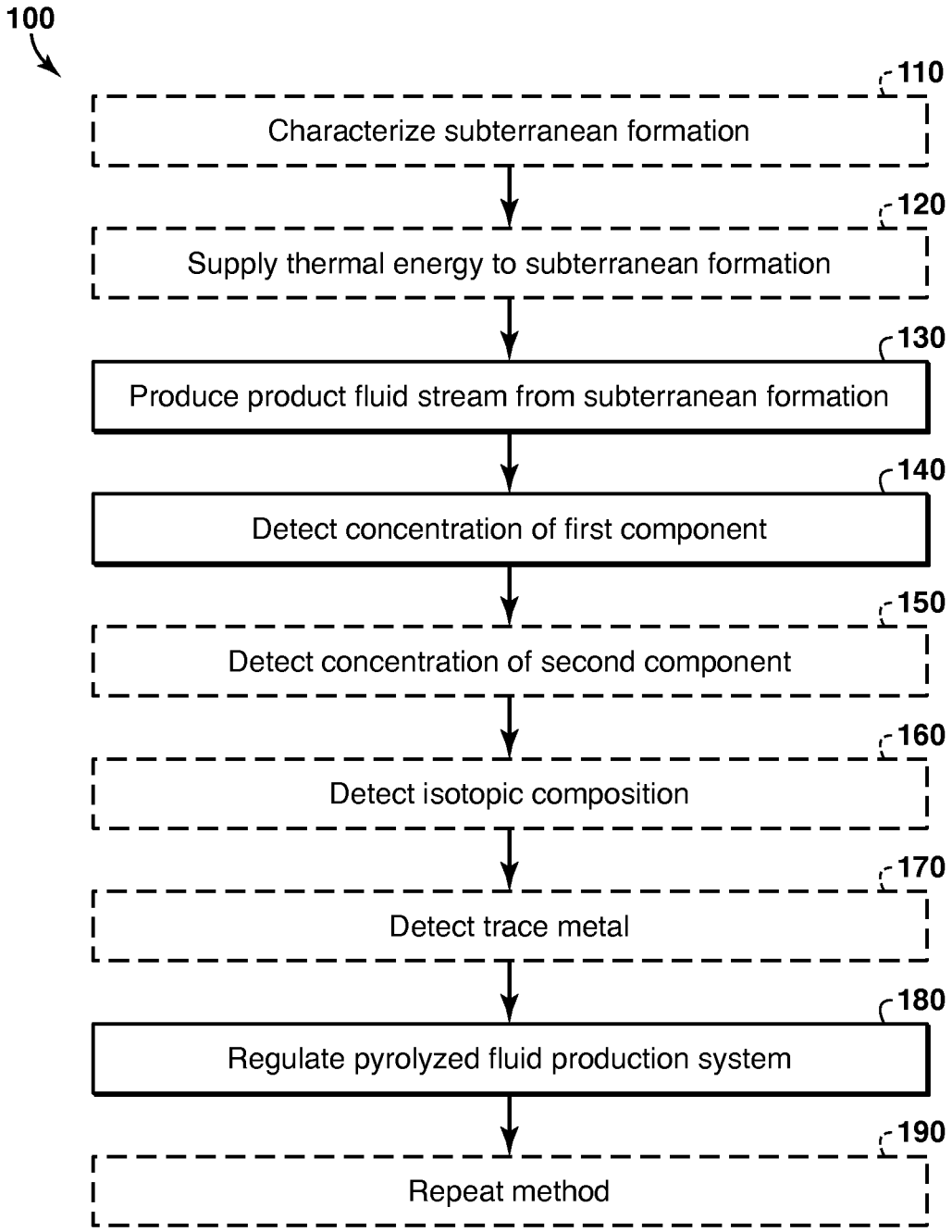
FIG. 4 is a flowchart depicting methods of regulating a pyrolyzed fluid production system.

FIG. 4 is flowchart depicting methods 100 of regulating a pyrolyzed fluid production system, such as system 10. Methods 100 may include characterizing a subterranean formation at 110, supplying thermal energy to the subterranean formation at 120, producing a product fluid stream from the subterranean formation at 130, and/or detecting a concentration of a first component in the product fluid stream at 140. Methods 100 may include detecting a concentration of a second component in the product fluid stream at 150, detecting an isotopic composition of an element that is present within the product fluid stream at 160, detecting a concentration of a trace metal in the product fluid stream at 170, regulating the pyrolyzed fluid production system at 180, and/or repeating the methods at 190.

Characterizing the subterranean formation at 110 may include characterizing, or quantifying, any suitable property of the subterranean formation and may be performed in any suitable manner and/or at any suitable time. For example, the characterizing at 110 may include characterizing the subterranean formation prior to the supplying at 120 and/or prior to the producing at 130. Characterizing at 110 may include collecting a plurality of samples of organic matter that is present within the subterranean formation at a plurality of respective sampling locations. Subsequently, the plurality of samples may be pyrolyzed to generate a plurality of product fluid samples. The plurality of product fluid samples then may be analyzed.

The analysis may include determining, or detecting, a concentration of the first component in each of the product fluid samples. The analysis may include detecting, or determining, a concentration of the second component in each of the product fluid samples. The analysis may include detecting, or determining, an isotopic composition of one or more elements that may be present in each of the fluid samples. The analysis may include detecting, or determining, a concentration of one or more trace metals that may be present in each of the product fluid samples.

Subsequently, a model, a correlation, a mathematical expression, and/or a database may be generated based upon the above-obtained data that describes the composition of the subterranean formation. For example, the model may describe the concentration of the first component within the subterranean formation (or within the product fluid stream that may be generated from the subterranean formation) as a function of location within the subterranean formation. The model may describe the concentration of the second component within the subterranean formation (or within the product fluid stream) as a function of location within the subterranean formation. The model may describe the isotopic composition within the subterranean formation (or within the product fluid stream) as a function of location within the subterranean formation. The model may describe the concentration of trace metal within the subterranean formation (or within the product fluid stream) as a function of location within the subterranean formation.

Supplying thermal energy to the subterranean formation at 120 may include supplying the thermal energy to heat the active pyrolysis region and/or to generate the product fluid stream. The supplying at 120 may be accomplished in any suitable manner. For example, the supplying at 120 may include providing electric current to a resistance heater to electrically heat the active pyrolysis region. The supplying at 120 may include combusting a fuel with an oxidant within the subterranean formation to heat the active pyrolysis region. The supplying at 120 may include providing steam, or another heated fluid stream, to the subterranean formation to heat the active pyrolysis region.

Producing the product fluid stream from the subterranean formation at 130 may include producing the product fluid stream from the active pyrolysis region. The producing at 130 may include producing via a production well that extends between a surface region and the subterranean formation.

The producing at 130 may be accomplished in any suitable manner. For example, the producing at 130 may include producing via a single production well. The producing at 130 may include producing a plurality of discrete product fluid streams via a plurality of production wells, each of which may extend between the surface region and the subterranean formation.

Under these conditions, the detecting at 140 may include detecting a plurality of discrete concentrations of the first component in the plurality of discrete product fluid streams. Similarly, the detecting at 150 may include detecting a plurality of discrete concentrations of the second component in the plurality of discrete product fluid streams. The detecting at 160 may include detecting a plurality of discrete isotopic compositions in the plurality of discrete product fluid streams. The detecting at 170 may include detecting a plurality of discrete concentrations of the trace metal in the plurality of discrete product fluid streams. The regulating at 180 may include regulating at least one characteristic of the pyrolyzed fluid production system based, at least in part, on the plurality of discrete concentrations of the first component, the plurality of discrete concentrations of the second component, the plurality of discrete isotopic compositions, and/or the plurality of discrete concentrations of the trace metal.

Detecting the concentration of the first component in the product fluid stream at 140 may include detecting the concentration of the first component in any suitable manner. The concentration of the first component optionally may be referred to herein as a concentration of a temperature-sensitive component. The concentration of the first component may be indicative of an intensive property of the pyrolyzed fluid production system, such as of a representative temperature of the active pyrolysis region.

The concentration of the first component may be detected at any suitable location within the pyrolyzed fluid production system. For example, the concentration of the first component may be detected within a wellbore that defines the production well and/or that extends between the surface region and the subterranean formation. The concentration of the first component may be detected within the subterranean formation. The concentration of the first component may be detected in the surface region.

The detecting at 140 may include detecting a magnitude of the concentration of the first component, a concentration ratio of two different materials that comprise the first component, a change in the magnitude of the concentration, and/or a change in the concentration ratio. For example, the concentration ratio may be defined as the concentration of the first component divided by a reference concentration. For example, the reference concentration may be an initial concentration of the first component.

Detecting the concentration of the second component in the product fluid stream at 150 may include detecting the concentration of the second component in any suitable manner. The concentration of the second component may be indicative of an extensive property of the pyrolyzed fluid production system. The extensive property may include a representative residence time for the product fluid stream within the subterranean formation, a representative flow rate of the product fluid stream within the subterranean formation, a representative speed of the product fluid stream as it flows through the subterranean formation, and/or a representative distance between the active pyrolysis region and a detector that is utilized to detect the concentration of the second component.

The concentration of the second component may be detected at any suitable location within the pyrolyzed fluid production system. The concentration of the second component may be detected within a wellbore that defines the production well and/or that extends between the surface region and the subterranean formation. The concentration of the second component may be detected within the subterranean formation. The concentration of the second component may be detected in the surface region.

The detecting at 150 may include detecting a magnitude of the concentration of the second component, a concentration ratio of two different materials that comprise the second component, a change in the magnitude of the concentration, and/or a change in the concentration ratio. For example, the concentration ratio may be defined as the concentration of the second component divided by a reference concentration. For example, the detecting at 150 may include detecting a concentration of a time-sensitive second component and also detecting a concentration of a time-insensitive second component and calculating a normalized concentration of the time-sensitive second component divided by the concentration of the time-insensitive second component. For example, the time-sensitive second component may include, or be, a pyrrole and the time-insensitive second component may include, or be, an indole. Under these conditions, the regulating at 180 may be based, at least in part, on the normalized concentration of the time-sensitive second component.

Detecting the isotopic composition of the element that is present within the product fluid stream at 160 may include detecting any suitable isotopic composition, or concentration, of any suitable element, or elements, within the product fluid stream. The detecting at 160 may include detecting the concentration of the isotope. The detecting at 160 also may include detecting, or determining, a ratio of a concentration of a first isotope to a concentration of a second isotope. The detecting at 160 may include determining a delta value for one or more elements that may be present in the product fluid stream.

The detecting at 160 may include detecting the isotopic composition a plurality of times (and/or at a plurality of different times) to determine the isotopic composition as a function of time. The isotopic composition as a function of time (or a change in the isotopic composition as a function of time) then may be utilized to determine one or more characteristic of the subterranean formation. The regulating at 180 also may include regulating based, at least in part, on the isotopic composition and/or on the change in the isotopic composition as a function of time.

For example, a change in the isotopic composition as a function of time may indicate (or may be utilized to indicate) that the active pyrolysis region has transitioned from a first, initial, or given strata of the subterranean formation to a second, or subsequent, strata of the subterranean formation. Determining that the active pyrolysis region has transitioned from the first strata to the second strata may be based, at least in part, upon information gained during the characterizing at 110.

The detecting at 160 may include detecting an isotopic composition of sulfur within the product fluid stream. The isotopic composition of sulfur then may be utilized to determine one or more properties of the subterranean formation and/or of the active pyrolysis region. For example, methods 100 may include determining a composition of one or more inorganic species present within the subterranean formation based, at least in part, on the isotopic composition of sulfur. The regulating at 180 also may be based, at least in part, on the isotopic composition of sulfur.

The detecting at 160 may include detecting an isotopic composition of oxygen within the product fluid sample. The isotopic composition of oxygen then may be utilized to determine one or more properties of the subterranean formation and/or of the active pyrolysis region. For example, the product fluid stream may include both liquids and gasses (or produced liquids and produced gasses). Under these conditions, methods 100 may include determining a proportion of the produced gasses that are generated by decomposition of an inorganic species based, at least in part, on the isotopic composition of oxygen. Methods 100 also may include determining a proportion of the produced gasses that are generated by pyrolysis of an organic species based, at least in part, on the isotopic composition of oxygen. Furthermore, the regulating at 180 may be based, at least in part, on the isotopic composition of oxygen.

The detecting at 160 may include detecting an isotopic composition of carbon within the product fluid sample. The isotopic composition of carbon then may be utilized to determine one or more properties of the subterranean formation and/or of the active pyrolysis region. For example, methods 100 may include determining a proportion of the produced gasses that are generated by decomposition of an inorganic species based, at least in part, on the isotopic composition of carbon. As another example, methods 100 also may include determining a proportion of the produced gasses that are generated by pyrolysis of an organic species based, at least in part, on the isotopic composition of carbon. Furthermore, the regulating at 180 may be based, at least in part, on the isotopic composition of carbon.

Detecting the concentration of the trace metal in the product fluid stream at 170 may include detecting the concentration of any suitable trace metal within the product fluid stream. This may include detecting any suitable concentration of the trace metal, any suitable ratio of concentrations of two different trace metals, and/or any suitable change in concentration of the trace metal as a function of time. The regulating at 180 may include regulating based, at least in part, on the trace metal concentration and/or on the change in trace metal concentration as a function of time.

The trace metal concentration may be utilized in any suitable manner. For example, the characterizing at 110 may include determining a trace metal distribution within the subterranean formation. Under these conditions, the location of the active pyrolysis region may be determined based, at least in part, on the trace metal concentration and/or on the trace metal distribution.

Regulating the pyrolyzed fluid production system at 180 may include regulating at least one characteristic of the pyrolyzed fluid production system based, at least in part, on the characterizing at 110 and/or on the model, correlation, mathematical expression, and/or database that may be generated thereby. The regulating at 180 may include regulating based, at least in part, on the detecting at 140 and/or on the concentration of the first component and/or the change in concentration of the first component with time that may be detected during the detecting at 140. The regulating at 180 may include regulating based, at least in part, on the detecting at 150 and/or on the concentration of the second component and/or the change in concentration of the second component with time that may be detected during the detecting at 150. The regulating at 180 may include regulating based, at least in part, on the detecting at 160 and/or on the isotopic composition and/or the change in isotopic composition with time that may be detected during the detecting at 160. The regulating at 180 may include regulating based, at least in part, on the detecting at 170 and/or on the trace metal concentration and/or the change in trace metal concentration with time that may be detected during the detecting at 170.

The regulating at 180 may include determining a representative temperature of the active pyrolysis region. The regulating at 180 also may include determining a location of the active pyrolysis region within the subterranean formation. This may include determining a depth of the active pyrolysis region. This also may include determining a representative flow distance for the product fluid stream between the active pyrolysis region and the surface region. The regulating at 180 further may include regulating a rate at which thermal energy is supplied to the subterranean formation during the supplying at 120.

The characterizing at 110, the supplying at 120, the producing at 130, the detecting at 140, the detecting at 150, the detecting at 160, and/or the detecting at 170 may be performed by the pyrolyzed fluid production system. The characterizing at 110, the supplying at 120, the producing at 130, the detecting at 140, the detecting at 150, the detecting at 160, and/or the detecting at 170 also may be performed by a first pyrolyzed fluid production system, and the regulating at 180 may include regulating a second pyrolyzed fluid production system that is separate from, spaced apart from, and/or distinct from the first pyrolyzed fluid production system. Under these conditions, the regulating at 180 also may include regulating a trajectory of a second production well that is associated with the second pyrolyzed fluid production system. The regulating at 180 further may include regulating a location of a heating assembly that is associated with the second pyrolyzed fluid production system.

The second pyrolyzed fluid production system may be (at least partially) different from the first pyrolyzed fluid production system. The second pyrolyzed fluid production system also may be (at least partially) coextensive with the first pyrolyzed fluid production system. For example, the first pyrolyzed fluid production system and the second pyrolyzed fluid production system may be configured to produce respective product fluid streams from the same subterranean formation.

The second pyrolyzed fluid production system may not be coextensive with the first pyrolyzed fluid production system. For example, the first pyrolyzed fluid production system and the second pyrolyzed fluid production system may be configured to produce respective product fluid streams from different (or spaced-apart) subterranean formations.

The concentration of the first component that is detected during the detecting at 140 may be indicative of a representative temperature of the active pyrolysis region. When the concentration of the first component is indicative of the representative temperature, the regulating at 180 may include increasing the rate at which thermal energy is supplied to the subterranean formation (during the supplying at 120) responsive to determining that the representative temperature of the active pyrolysis region is less than a threshold minimum representative temperature. The regulating at 180 also may include decreasing the rate at which thermal energy is supplied to the subterranean formation responsive to determining that the representative temperature of the active pyrolysis region is greater than a threshold maximum representative temperature.

The concentration of the second component that is detected during the detecting at 150 may be indicative of a residence time (or a representative residence time) of the product fluid stream within the subterranean formation. When the concentration of the second component is indicative of the residence time, the regulating at 180 may include increasing the rate at which thermal energy is supplied to the subterranean formation responsive to determining that the representative residence time of the product fluid stream is greater than a threshold maximum representative residence time. Increasing the rate at which thermal energy is supplied to the subterranean formation may fracture the subterranean formation and/or otherwise increase a fluid permeability of the subterranean formation. The regulating at 180 also may include decreasing the rate at which thermal energy is supplied to the subterranean formation responsive to determining that the representative residence time of the product fluid stream is less than a threshold minimum representative residence time. Decreasing the rate at which thermal energy is supplied to the subterranean formation may permit additional aging of organic matter within the subterranean formation prior to production of the product fluid stream.

Repeating the methods at 190 may include repeating any suitable portion of methods 100. For example, the repeating at 190 may include repeating the detecting at 140, repeating the detecting at 150, repeating the detecting at 160, and/or repeating the detecting at 170 a plurality of times. As another example, the repeating at 190 also may include repeating the regulating at 180. Repeating the regulating at 180 may include utilizing any suitable feedback and/or feedforward control strategy to control, or regulate, the operation of the pyrolyzed fluid supply system The repeating at 190 may include repeating the detecting at 140 a plurality of times to determine a plurality of concentrations of the first component. Under these conditions, methods 100 further may include determining a reference concentration of the first component (such as an initial concentration of the first component, an average concentration of the first component, a minimum concentration of the first component, and/or a maximum concentration of the first component). Methods 100 then may include dividing the plurality of concentrations of the first component by the reference concentration of the first component to generate a plurality of normalized concentrations of the first component. The regulating at 180 may include regulating based, at least in part, on the plurality of normalized concentrations of the first component.

The repeating at 190 may include repeating the detecting at 150 a plurality of times to determine a plurality of concentrations of the second component. Under these conditions, methods 100 further may include determining a reference concentration of the second component (such as an initial concentration of the second component, an average concentration of the second component, a minimum concentration of the second component, a maximum concentration of the second component, and/or a concentration of one or more materials that comprise the second component). Methods 100 then may include dividing the plurality of concentrations of the second component by the reference concentration of the second component to generate a plurality of normalized concentrations of the second component. The regulating at 180 may include regulating based, at least in part, on the plurality of normalized concentrations of the second component.

For example, the detecting at 150 may include detecting a concentration of a time-sensitive second component a plurality of times to determine a plurality of concentrations of the time-sensitive second component. The detecting at 150 may include detecting a concentration of a time-insensitive second component a plurality of times to determine a plurality of concentrations of the time-insensitive second component. The repeating at 190 may include dividing each of the plurality of concentrations of the time-sensitive second component by a corresponding concentration of the time-insensitive second component to generate a plurality of normalized concentrations of the time-sensitive second component. For example, and when the second component is a nitrogen-containing hydrocarbon, the plurality of normalized concentrations of the time-sensitive second component may be generated by dividing a pyrrole concentration by an indole concentration (or by a sum of the pyrrole concentration and the indole concentration). The regulating at 180 may be based, at least in part, on the plurality of normalized concentrations of the time-sensitive second component.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are novel and non-obvious. Other combinations and subcombinations of features, functions, elements and/or properties may be claimed through amendment of the present claims or presentation of new claims in this or a related application. Such amended or new claims, whether different, broader, narrower, or equal in scope to the original claims, are also regarded as included within the subject matter of the present disclosure.

The invention claimed is:

1. A method of regulating a pyrolyzed fluid production system, the method comprising:

producing a product fluid stream from an active pyrolysis region, which is contained within a subterranean formation that includes organic matter, via a production well that extends between a surface region and the subterranean formation;

detecting a concentration of a first component in the product fluid stream, wherein the concentration of the first component is indicative of an intensive property of the pyrolyzed fluid production system;

detecting a concentration of a second component in the product fluid stream, wherein the concentration of the second component is indicative of an extensive property of the pyrolyzed fluid production system; and regulating at least one characteristic of the pyrolyzed fluid production system based, at least in part, on the concentration of the first component and on the concentration of the second component.

2. The method of claim 1, wherein the intensive property is a representative temperature of the active pyrolysis region.

3. The method of claim 1, wherein a half-life of the first component within the product fluid stream is at least 1 year.

4. The method of claim 1, wherein the first component is at least one of:

(i) a sulfur-containing hydrocarbon;
(ii) a sulfur-containing hydrocarbon ring;
(iii) a thiophene;
(iv) a benzothiophene; and
(v) a dibenzothiophene.

5. The method of claim 1, wherein the detecting the concentration of the first component includes at least one of:

(i) detecting the concentration of the first component within a wellbore that extends between the surface region and the subterranean formation;
(ii) detecting the concentration of the first component within the subterranean formation;
(iii) detecting the concentration of the first component within the surface region; and
(iv) detecting a change in the concentration of the first component with time.

6. The method of claim 1, wherein the extensive property is one of:

(i) a representative residence time of the product fluid stream within the subterranean formation;
(ii) a representative flow rate of the product fluid stream within the subterranean formation;
(iii) a representative speed of the product fluid stream within the subterranean formation; and
(iv) a representative distance between the active pyrolysis region and a detector that is utilized to detect the concentration of the second component.

7. The method of claim 1, wherein the second component is reactive within the product fluid stream.

8. The method of claim 1, wherein a half-life of the second component within the product fluid stream is at least one of:

(i) less than 3 months; and
(ii) less than a representative residence time of the product fluid stream within the subterranean formation.

9. The method of claim 1, wherein the second component is at least one of:

(i) a nitrogen-containing hydrocarbon;
(ii) a nitrogen-containing hydrocarbon ring;
(iii) a pyridine;
(iv) a quinoline;
(v) a pyrrole;
(vi) an indole; and
(vii) a carbazole.

10. The method of claim 1, wherein the detecting the concentration of the second component includes at least one of:

(i) detecting the concentration of the second component within a wellbore that extends between the surface region and the subterranean formation;
(ii) detecting the concentration of the second component within the subterranean formation;
(iii) detecting the concentration of the second component within the surface region; and
(iv) detecting a change in the concentration of the second component with time.

11. The method of claim 1, wherein the producing, the detecting the concentration of the first component, and the detecting the concentration of the second component are performed by the pyrolyzed fluid production system.

12. The method of claim 1, wherein the regulating includes determining a representative temperature of the active pyrolysis region.

13. The method of claim 1, wherein the regulating includes determining a location of the active pyrolysis region within the subterranean formation.

14. The method of claim 1, wherein the pyrolyzed fluid production system is a second pyrolyzed fluid production system, wherein the regulating includes regulating the at least one characteristic of the second pyrolyzed fluid production system, and further wherein the producing, the detecting the concentration of the first component, and the detecting the concentration of the second component are performed within a first pyrolyzed fluid production system that is different from the second pyrolyzed fluid production system.

15. The method of claim 14, wherein the regulating includes regulating at least one of:

(i) a trajectory of a production well that is associated with the second pyrolyzed fluid production system; and
(ii) a location of a heating assembly that is associated with the second pyrolyzed fluid production system.

16. The method of claim 1, wherein the method further includes detecting an isotopic composition of an element that is present within the product fluid stream.

17. The method of claim 16, wherein the method includes repeating the detecting the isotopic composition to determine a plurality of isotopic compositions, and further wherein the method includes determining that the active pyrolysis region has transitioned from a first strata of the subterranean formation to a second strata of the subterranean formation based, at least in part, on a change in the isotopic composition.

18. The method of claim 16, wherein the regulating includes regulating based, at least in part, on the isotopic composition.

19. The method of claim 1, wherein the method further includes detecting a concentration of a trace metal in the product fluid stream, wherein, the method further includes determining a trace metal distribution within the subterranean formation, and further wherein the method includes determining a location of the active pyrolysis region within the subterranean formation based, at least in part, on the concentration of the trace metal.

20. The method of claim 19, wherein the regulating includes regulating based, at least in part, on the concentration of the trace metal.

21. The method of claim 1, wherein, prior to the producing, the method further comprises:

collecting a plurality of organic matter samples of the organic matter, wherein each of the plurality of organic matter samples corresponds to a respective sampling location within the subterranean formation;

pyrolyzing the plurality of organic matter samples to generate a plurality of product fluid samples;

detecting a concentration of the first component in each of the product fluid samples;

detecting a concentration of the second component in each of the product fluid samples; and generating a model that describes the concentration of the first component and the concentration of the second component within the subterranean formation, wherein the model is based, at least in part, on the concentration of the first component in each of the product fluid samples, the concentration of the second component in each of the product fluid samples, and the respective sampling location for a corresponding sample of the plurality of organic matter samples.

22. The method of claim 1, wherein the method further includes supplying thermal energy to the subterranean formation to heat the active pyrolysis region and to generate the product fluid stream.

23. The method of claim 22, wherein the intensive property is a representative temperature of the active pyrolysis region, and further wherein the regulating further includes at least one of:

(i) increasing a rate at which thermal energy is supplied to the subterranean formation responsive to determining that the representative temperature of the active pyrolysis region is less than a threshold representative temperature; and (ii) decreasing the rate at which thermal energy is supplied to the subterranean formation responsive to determining that the representative temperature of the active pyrolysis region is greater than the threshold representative temperature.

24. The method of claim 22, wherein the extensive property is a representative residence time of the product fluid stream within the subterranean formation, and further wherein the regulating includes at least one of:

(i) increasing a rate at which thermal energy is supplied to the subterranean formation responsive to determining that the representative residence time of the product fluid stream is greater than a threshold maximum representative residence time; and (ii) decreasing the rate at which thermal energy is supplied to the subterranean formation responsive to determining that the representative residence time of the product fluid stream is less than the threshold minimum representative residence time.

25. The method of claim 22, wherein the regulating includes regulating a rate at which thermal energy is supplied to the subterranean formation.

26. A method of regulating a temperature of an active pyrolysis region within a subterranean formation, the method comprising:

supplying thermal energy to the subterranean formation to heat the active pyrolysis region of the subterranean formation and to generate a product fluid stream therefrom;

producing the product fluid stream from the subterranean formation via a production well that extends between a surface region and the subterranean formation;

detecting a concentration of a temperature-sensitive component in the product fluid stream, wherein the concentration of the temperature-sensitive component is indicative of a temperature of the active pyrolysis region; and regulating a rate of the supplying thermal energy based, at least in part, on the concentration of the temperature-sensitive component.

* * * * *